US009435181B1

(12) United States Patent
Harris et al.

(10) Patent No.: US 9,435,181 B1
(45) Date of Patent: Sep. 6, 2016

(54) RETRIEVABLE GAS LIFT VALVE SYSTEM

(71) Applicants: Robert Harris, Anchorage, AK (US); Carl Diller, Anchorage, AK (US); John Milne, Anchorage, AK (US); Candice English, Anchorage, AK (US)

(72) Inventors: Robert Harris, Anchorage, AK (US); Carl Diller, Anchorage, AK (US); John Milne, Anchorage, AK (US); Candice English, Anchorage, AK (US)

( * ) Notice: Subject to any disclaimer, the term of this patent is extended or adjusted under 35 U.S.C. 154(b) by 392 days.

(21) Appl. No.: 14/220,484

(22) Filed: Mar. 20, 2014

(51) Int. Cl.
*E21B 34/10* (2006.01)
*E21B 43/12* (2006.01)

(52) U.S. Cl.
CPC ..... *E21B 43/123* (2013.01)

(58) Field of Classification Search
CPC .... E21B 34/105; E21B 43/12; E21B 43/121; E21B 43/122; E21B 43/123
USPC ..... 166/370, 372; 417/118
See application file for complete search history.

(56) References Cited

U.S. PATENT DOCUMENTS 2,633,086 A * 3/1953 Zaba ..... E21B 43/122 417/111
2,697,988 A * 12/1954 Stewart ..... E21B 43/122 166/136
3,016,844 A * 1/1962 Vincent ..... E21B 43/122 137/155
3,675,714 A * 7/1972 Thompson ..... E21B 43/123 137/155
3,675,720 A * 7/1972 Sizer ..... E21B 23/02 166/115
4,860,825 A * 8/1989 Corteville ..... E21B 43/124 166/105
5,427,133 A * 6/1995 Pringle ..... E21B 17/20 137/155
6,705,404 B2 * 3/2004 Bosley ..... E21B 43/123 166/108

* cited by examiner

*Primary Examiner* — Kenneth L Thompson
(74) *Attorney, Agent, or Firm* — Michael J. Tavella

(57) ABSTRACT

A replaceable gas lift valve system. In this system, the device is inserted into the production tubing (or gas producing zone) at a desired level. This allows gas to be pumped down the space between the casing and production tubing (or flowed from the zone). Although the tool is placed in the production tubing, space is provided to allow almost normal production through the tool. Once in place, the device has a metering valve that allows the appropriate amount of gas of other fluid to enter the production tubing to provide lift for the oil. If the device fails, it can be quickly extracted and a replacement device quickly installed. Once installed, the replacement device allows resumed production. The recovered device can be dismantled, repaired and staged for another quick replacement where needed.

14 Claims, 6 Drawing Sheets

RETRIEVABLE GAS LIFT VALVE SYSTEM

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to gas lift valve systems and particularly to replaceable gas lift valve system.

2. Description of the Prior Art

Gas lift systems have been used in oil wells to help increase production. In practice, a gas lift mandrel is permanently installed in the production line (either tubing or liners, for example). Once in place, the mandrel can be idle until such time as a gas injection program is desired. At that time, a hole is punched in the side of the gas lift mandrel and a gas lift valve is installed such that gas can be injected into the well between the casing and the production tubing, through the mandrel in to the gas lift valve, which is positioned to transfer the gas from the casing to the production tubing, where it mixes with the oil and aids in the flow of the oil through the production tubing. The main function of the gas lift valve is to meter the flow of gas into the production tubing to maximize the beneficial effects of the gas.

Over time, the gas lift valves corrode and have to be replaced. This operation can be done with current well technology. The major problem with this system is the mandrels are permanently installed. Because the gas and is highly corrosive, eventually, the mandrel fails. When this happens, the control of the flow of gas is eliminated and the gas flows freely into the production tubing, effectively stopping the flow of oil. There is no present way to repair the mandrel and after the mandrel fails, the well is typically shut in and it must be completely reworked to get production restarted. This is a very expensive solution for an aging well.

BRIEF DESCRIPTION OF THE INVENTION

The instant invention overcomes these difficulties. It is a replaceable gas lift valve system. In this system, the device is inserted into the production tubing, liner or other conduit (which is known as the gas producing zone) at a desired level. A hole is formed in the gas-producing zone to allow gas to be injected. The device is positioned adjacent to the opening. This allows gas to be pumped down the space between the casing and the production tubing, for example, as before. Because the tool is essentially fills the inside of the gas-producing zone, space is provided to allow almost normal production through the tool. Once in place, the device has a metering valve that allows the appropriate amount of gas or other fluid to enter the gas-producing zone to provide lift for the oil.

Over time, the corrosive effect will cause the valve to fail. Once this happens, the device can be quickly extracted using standard slick line techniques and a replacement unit quickly installed. Once installed, the replacement device allows resumed production. The recovered device can be dismantled, repaired and staged for another quick replacement where needed.

The difference here is that the entire unit, which consists of a mandrel and a valve, can be replaced. This capability allows gas injection to occur without ever having to shut in the well because of mandrel failure. Moreover, unlike the permanently installed gas lift mandrels, which are installed in fixed locations during the initial well completion, the instant device can be installed in any level desired within the well.

DETAILED DESCRIPTION OF THE INVENTION

Figure 1:
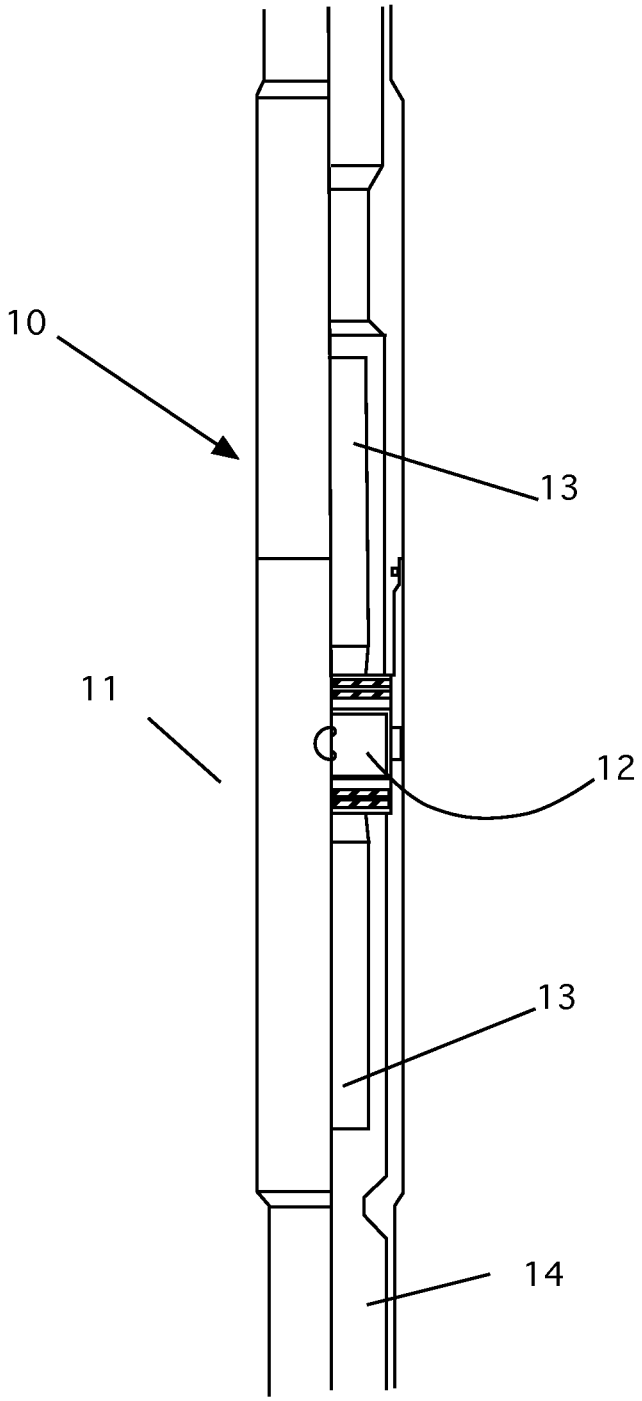
FIG. 1 is a partial cutaway view of the invention.

Referring now to FIG. 1, a partial cutaway view of the invention 10 is shown. In this view, on the left is shown the outer shell 11 of the device 10, which is the mandrel. This mandrel is standard steel. On the right, the inner working of the device 10 are shown. At the center of the device is a gas lift valve 12. A gas mixing tube 13 allows the injected gas to mix with the production fluids (see e.g., FIG. 2). Production fluids travel through a flow pipe that has a lower unit 14 and an upper unit 15. Thus, once this device is installed production can continue while the gas is being injected.

Figure 2:
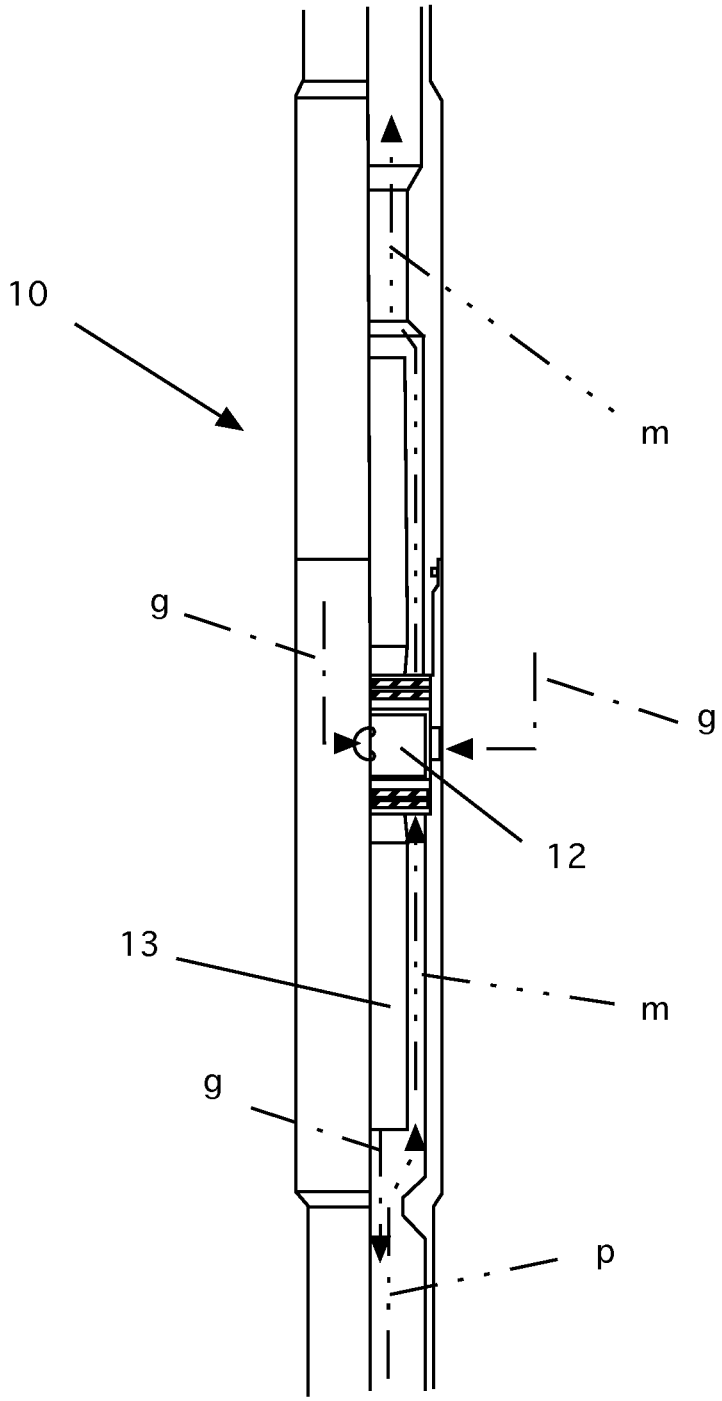
FIG. 2 is the partial cutaway view of FIG. 1 showing the flow of gas and fluid through the device.

FIG. 2 is the partial cutaway view of FIG. 1 showing the flow of gas and fluid through the device. In this view, injected gas (represented by the dashed lines labeled g) is pumped into the production tubing though the lift valve 12. The gas g exits the valve through tube 13, where it mixes with production fluids represented by the dashed line labeled p. After the gas and production fluids mix, they pass upwards through the device. This mixture is represented by the dashed lines labeled m.

Figure 3:
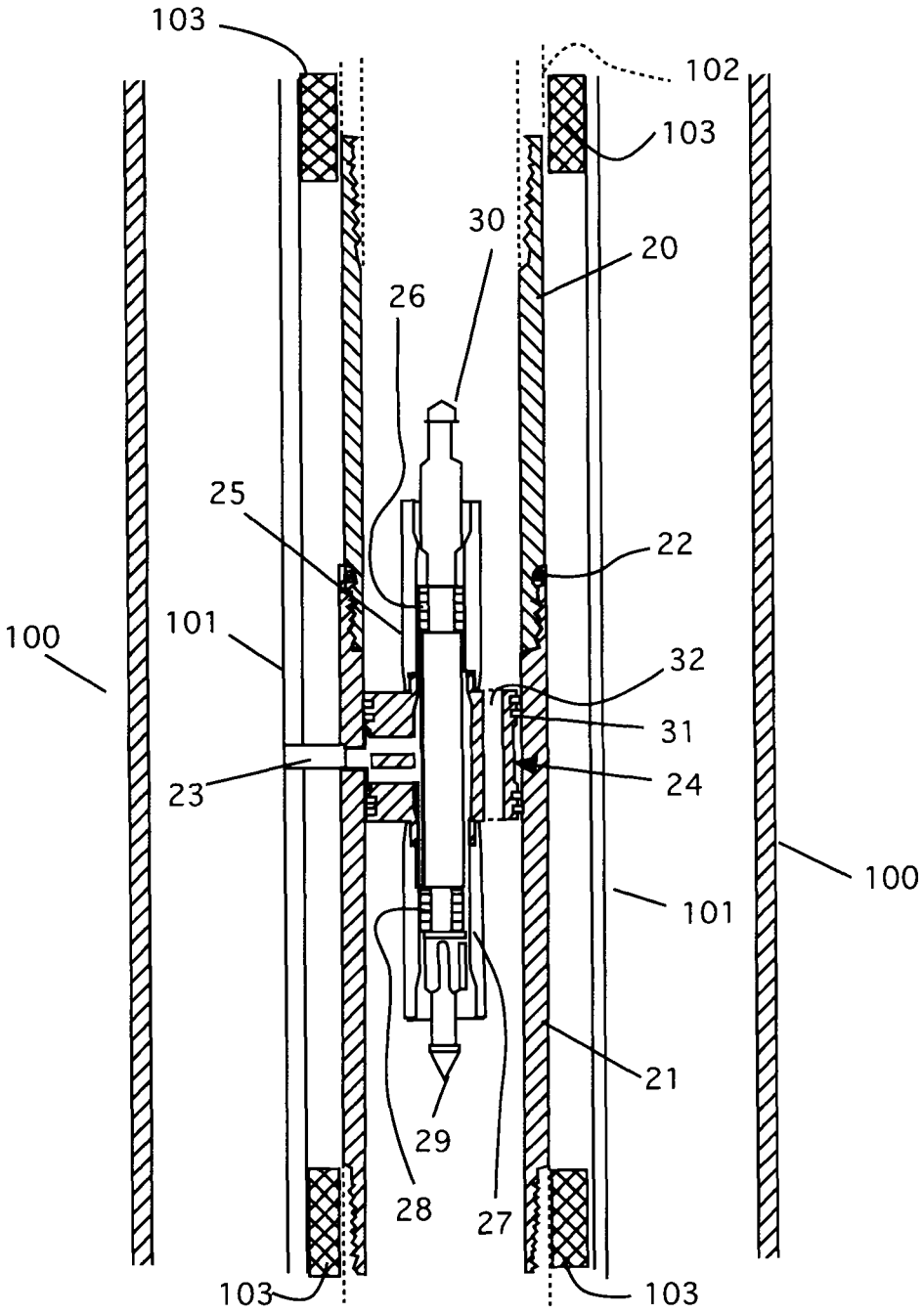
FIG. 3 is a detail interior view of the device installed in a well.

FIG. 3 is a detail interior view of the device installed in a well. In this view, the outer casing 100. Within the outer casing 100 is a line of production tubing 101. Note that in this view, for the sake of illustration, production tubing is shown although the device can be installed in many other configurations and other pipes such as liners. Note also that the spacing shown is exaggerated for clarity. As shown, production tubing 101 is run within the casing 100. The device is installed in a line of patch tubing 102. As part of that string an upper mandrel portion 20 is threadably attached to a lower mandrel portion 21. At the junction of the upper and lower mandrel portions is a seal 22. Mandrel packers 103 are installed above and below the mandrel portions as shown. These ensure a seal between the production tubing and the patch tubing.

An entry port 23 is provided on the lower mandrel that allows for the entry of gas (see, FIG. 4), which is pumped down between the casing and the production pipe. The entry port is aligned with a hole in the production tubing as shown. The entry port is also in contact with the gas lift valve 24, which, as described above, is used to mix the gas with the production fluids in the well. The lift valve 24 is fitted between an upper seal sub 25 that has a seal 26 in it, and a lower seal sub 27 that has a seal 28 in it. At the base of the unit is a guide point 29. At the top of the unit is a fish neck 30. Note that there are seals 31 (see also FIG. 6) located on the gas lift valve that seal the valve to the lower housing when installed. A fish neck 30 allows the device to be set in a well and positioned where desired. When the lift valve fails, it can be retrieved by using the fish neck. The damaged unit can be pulled and quickly replaced with a new unit, thereby allowing the continued operation of the well. Another key feature, as discussed below is the production flow portion 32 in the gas lift valve, through which the production fluids continue to flow. Note that the installation within the production tubing can be at the location of a corroded existing permanently installed gas lift mandrel as well. The installation is the same. Unlike the case of a permanently installed gas lift mandrel, however, when the mandrel portions 20 or 21 corrode, the patch tubing string can be pulled and a new string with a new mandrel can be installed in its place. This is impossible in a standard oil well and is the biggest advantage that the instant invention has over the prior art.

Figure 4:
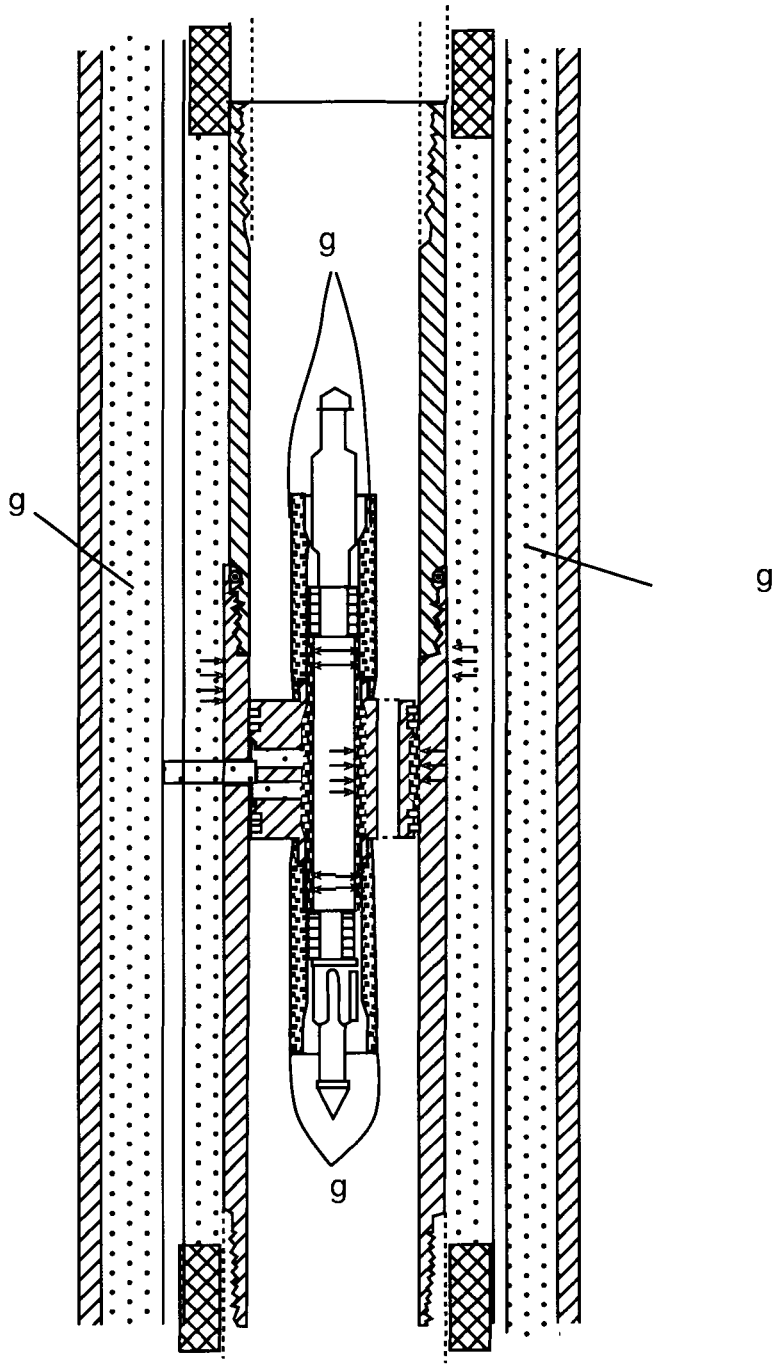
FIG. 4 is the detail interior view of FIG. 3 showing the movement of gas.

FIG. 4 is the detail interior view of FIG. 3 showing the movement of gas and the pressure diagram. Here, the same view as in FIG. 3 is shown only in this view, the gas g is shown in the system as a series of dots. Note that the arrows show the pressures on the system imposed by the gas g.

Figure 5:
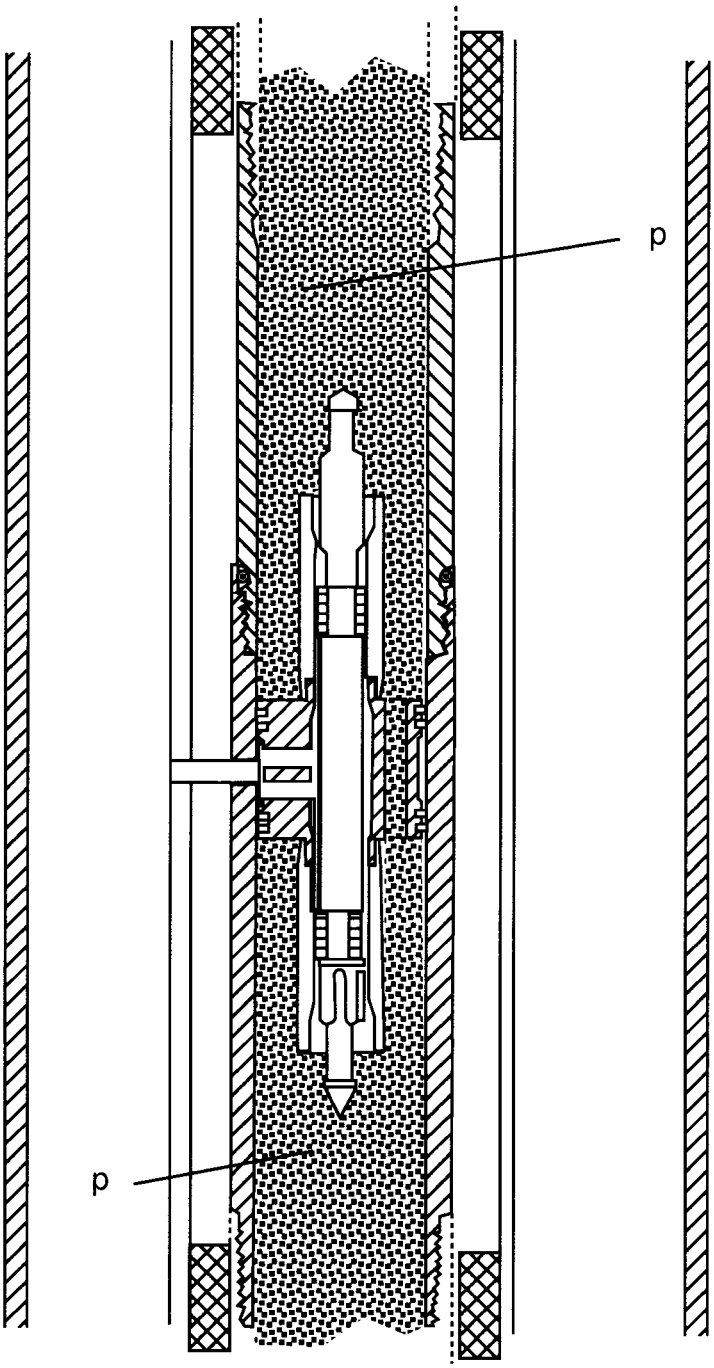
FIG. 5 is the detail interior view of FIG. 3 showing the movement of oil and oil/gas mix.

FIG. 5 is the detail interior view of FIG. 3 showing the movement of oil and oil/gas mix. As before, this view reproduces that of FIG. 3 with the production fluids shown p shown as a dense pattern. Note too, as before, pressure is indicated by arrows on the figure. As note that one of the key features is the production flow portion 32 in the gas lift valve. As shown in FIG. 5, production fluids pass through the valve through this portion. It is this portion that allows the unit to be installed in a well as it is designed not to impede the flow of regular production fluids. It is important to remember that even though the production flow portion 32 is smaller that that of the regular production tubing, this unit is used in wells that are near the end of their operational life and, as such, regular production flows are generally considerably slower than normal flows. Thus, the installation of the unit is not an impediment to the flows in the well.

Figure 6:
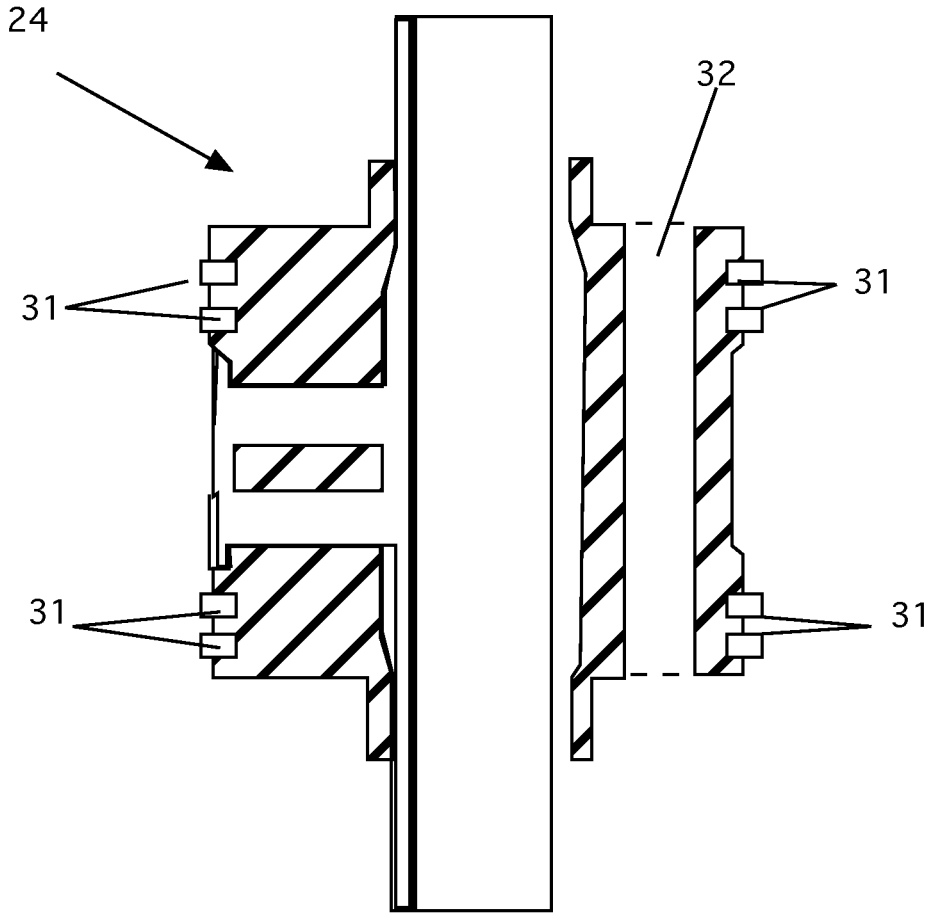
FIG. 6 is an enlarged cross-sectional of the lift valve.

FIG. 6 is an enlarged cross-sectional of the lift valve. Here, the gas lift valve 24 is shown clearly showing the seals 31 and the production flow portion 32 in the valve.

In use, the well is prepared for gas injection as normal. However, instead of installing a permanent gas lift valve, the unit is positioned in place. Gas is then injected and production continues as normal. Eventually, the gas lift valve will corrode through and production will be curtailed. At this point, the unit is retrieved using common fish tools and a new unit is positioned in its place. In this way, a low production well can continue to produce for many years.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A replaceable gas lift valve system comprising:

a) a mandrel;

b) an upper sealing sub having a fish neck installed thereon, removably installed within said mandrel;

c) a gas lift valve having a production flow portion, formed therein attached to said upper sealing sub, said production flow portion comprising a vertical tube formed with in gas lift valve; and d) a lower seal sub attached to said gas lift valve and extending downwardly therefrom.

2. The replaceable gas lift valve system of claim 1 wherein the gas lift valve further comprises a plurality of seals for sealingly positioning said gas lift valve within said mandrel.

3. The replaceable gas lift valve system of claim 1 wherein the mandrel is installed in a length of production tubing.

4. The replaceable gas lift valve system of claim 3 further comprising a plurality of packers installed with in said production tubing above and below said mandrel.

5. The replaceable gas lift valve system of claim 1 wherein the mandrel is installed in a length of liner.

6. The replaceable gas lift valve system of claim 1 wherein the mandrel is installed in a gas-producing zone.

7. The replaceable gas lift valve system of claim 1 wherein the gas lift valve further includes an entry port in operable communication with said mandrel.

8. The replaceable gas lift valve system of claim 1 wherein the mandrel is placed at the location of an existing permanently installed gas lift mandrel.

9. The replaceable gas lift valve system of claim 1 wherein the mandrel is attached to a length of patch tubing.

10. A method of gas injection in an oil well having an outer casing, a length of production tubing installed in said outer casing, and a quantity of production fluids flowing within said length of production tubing, comprising the steps of:

a) forming an opening is said production tubing;

b) installing a gas lift valve system having a mandrel, an upper sealing sub having a fish neck installed thereon, a gas lift valve having a production flow portion formed therein attached to said upper sealing sub; and a lower seal sub attached to said gas lift valve and extending downwardly therefrom, within said length of production tubing such that said gas lift valve is aligned with and in communication with said opening in said production tubing;

c) injecting a quantity of gas into said outer casing such that said gas enters said opening in said length of production tubing and enters said gas lift valve;

d) mixing said gas and said quantity of production fluids; and e) moving said mixture of gas and production fluids through the production flow portion of said gas lift valve from a lower portion of said quantity of production tubing to a higher portion of said length of production tubing.

11. The method of claim 10 further comprising the step of: prior to step "a" of claim 10, attaching the mandrel to a length of patch tubing.

12. The method of claim 10 further comprising the steps of: prior to step "c" of claim 10, installing a packer below the mandrel and installing a packer above the mandrel.

13. The method of claim 10 further comprising the steps of a) having the gas lift valve corrode to a failure point;

b) fishing said gas lift valve from said well;

c) installing a second gas lift valve in said well to replace said gas lift valve; and d) continuing regular production in said oil well.

14. The method of claim 10 further comprising the steps of:

a) having the mandrel corrode to a failure point;

b) removing the gas lift system from said well by pulling the patch tubing from the well with the mandrel attached;

c) installing a second gas lift valve system in said well to replace said gas lift valve system; and d) continuing regular production in said oil well.

* * * * *